US005683512A

United States Patent [19]

Mailänder

[11] Patent Number: 5,683,512

[45] Date of Patent: Nov. 4, 1997

[54] VARNISHING MACHINE

[75] Inventor: Udo Mailänder, Bietigheim-Bissingen, Germany

[73] Assignee: LTG Lufttechnische GmbH, Stuttgart, Germany

[21] Appl. No.: 629,247

[22] Filed: Apr. 8, 1996

[30] Foreign Application Priority Data

Apr. 7, 1995 [DE] Germany ..... 195 13 131.2
Apr. 29, 1995 [DE] Germany ..... 195 15 823.7

[51] Int. Cl.[6] ..... B05C 1/00

[52] U.S. Cl. ..... 118/663; 118/712; 118/249; 118/262; 118/264; 118/265; 101/247

[58] Field of Search ..... 118/663, 688, 118/692, 708, 712, 249, 262, 264, 265, 46; 101/416.1, 424.2, 247, 216

[56] References Cited

U.S. PATENT DOCUMENTS

| | | | |
|---|---|---|---|
| 3,916,824 | 11/1975 | Knodel et al. | 118/262 |
| 4,610,216 | 9/1986 | Paulsen | 118/249 |
| 4,704,296 | 11/1987 | Leanna et al. | 118/249 |
| 4,815,413 | 3/1989 | Kota | 118/249 |
| 5,178,678 | 1/1993 | Koehler et al. | 118/262 |
| 5,228,390 | 7/1993 | Jahn | 101/247 |
| 5,272,975 | 12/1993 | Dettinger et al. | 101/247 |
| 5,536,314 | 7/1996 | Rannestad | 118/249 |

*Primary Examiner*—Laura Edwards
*Attorney, Agent, or Firm*—Anderson Kill & Olick, P.C.

[57] ABSTRACT

A varnishing machine having an arrangement for adjusting pressure between the varnishing and pressure cylinders and for compensating changes in rotational speed of the varnishing cylinder caused by soaking of the varnishing cylinder shell and/or regrinding of the varnishing cylinder, with the arrangement including two auxiliary side members for supporting the varnishing cylinder or pressure cylinder, two motor spindles for pivoting the two side members, respectively, pressure sensors for sensing the axial pressures applied by the two-motor spindles, a pressure regulator for controlling the applied pressures and thereby the pressure between the varnishing and pressure cylinders, and displacement sensor for sensing an angular position of one of the side members, the position signal generated by the displacement sensor being used as a control variable for controlling the rotational speed of the varnishing cylinder.

5 Claims, 2 Drawing Sheets

VARNISHING MACHINE

BACKGROUND OF THE INVENTION

The present invention relates to a machine for varnishing plate shaped workpieces movable between a varnishing cylinder, having a shell formed of a rubber or any other elastic material, and a hard pressure cylinder, with the varnishing machine including a rotational speed regulator or controller for compensating changes in the rotational speed caused by soaking of the varnishing cylinder shell or by regrinding of the cylinder, and a device for adjusting the pressure between the varnishing and the pressure cylinders.

Such varnishing machines are used, e.g., in manufacturing of drink cans, glass caps, or crown caps, where the workpieces, before being pressed, are covered with inner and outer varnish layer and, after pressing operation, with a protective varnish layer. The applied varnish should meet specific requirement so that it would not crack when the workpieces are subsequently subjected to stamping and deep-drawing.

In the old varnishing machine, varnish was just poured over a workpiece. The modern varnishing machines are designed with an object of insuring as economical use of varnish as possible. Therefore, often, the varnishing cylinders, which are adjusted for varnishing of surfaces in which blank areas need be provided, are fitted with exactly positioned cutouts or grooves. The advantage of the varnishing cylinders designed for varnishing of the entire surface of a workpiece consists in that they can be regrinded several times and, therefore, have an extended service life. However, due to the decrease of the diameter of the varnishing cylinder, which results from regrinding, the rotational speed of the varnishing cylinder need be adjusted. The adjustment of the rotational speed of the varnishing cylinder, to a lesser extent, is needed because of the soaking of the varnishing cylinder shell. Further, an exact adjustment of the pressure between the varnishing and pressure cylinders is necessary for obtaining of an extremely thin and, at the time, of a highly uniform varnish coating.

A varnishing machine of this type is known. The driving of the varnishing cylinder is effected by a pressure air-actuated slip clutch which enables a very fine control of the rotational speed of the varnishing cylinder during the operation of the varnishing machine. However, the control of the rotational speed requires participation of the operator. For effecting varnishing of surfaces with blank area, an electrical controller is used which monitors the adjustment of the varnishing cylinder. After the disconnection for adjusting purposes, a change lever is used for adjusting three operational conditions. Altogether, the following adjustment are important for a proper operation of the varnishing machine, namely, the adjustment of the varnishing cylinder and the varnish feed roller, the adjustment of all of the rollers, providing for their positioning parallel to each other, metering of the necessary amount of varnish. To this end, manually operating spindles are used. After effecting the necessary adjustments necessary for a particular operational condition, the varnishing cylinder and the varnish feed roller are fixed to the machine frame without any play. However, with these adjustments, a non-uniform contact pressure along the generatrix of the varnishing cylinder shell may occur, which, leads eventually to operating errors, and a desired reliability of the operation cannot be achieved.

Accordingly, an object of the invention is a varnishing machine of the above-described type which would insure obtaining of an extremely thin and highly uniform varnish coating.

Another object of the invention is a varnishing machine in which the adjustment of pressure between the varnishing and pressure cylinders and the varnishing cylinder and the varnish feed roller as well as compensation of changes of the rotational speed of the varnishing cylinder, which is caused by soaking of the varnishing cylinder shell, are effected automatically.

SUMMARY OF THE INVENTION

These and other objects of the present invention, which will become apparent hereinafter, are achieved by providing in a varnishing machine two auxiliary side members pivotally attached to the frame for supporting the opposite supports of one of the varnishing cylinder and the pressure cylinder, means for adjusting pressure between the varnishing and pressure cylinders, with the pressure adjusting means including two tilting motor spindles for pivoting the two auxiliary side members and having respective one ends thereof attached to the frame and respective another ends thereof attached to the two auxiliary side members respectively, pressure sensors for sensing axial pressure applied by each of the two motor spindles to a respective auxiliary side member, pressure regulators connected with the pressure sensors for controlling the axial pressure and thereby pressure between the varnishing and pressure cylinder to a predetermined constant value, a displacement sensor for sensing an angular position of one of the two auxiliary side members, and control means for compensating changes in rotational speed of the varnishing cylinder caused by one of soaking of the varnishing cylinder shell and regrinding, with a position signal generated by the displacement sensor being used as a control variable.

With the varnishing machine according to the present invention, the manual operations are substantially reduced. The necessary adjustments are effected completely automatically with a high speed. Any deviations of actual values from the set ones are immediately compensated. While the motor spindles, which are provided on both sides of the machine, operate independently from each other, nevertheless a uniform contact pressure between the varnishing and the pressure cylinders is insured. The motor spindles insure a very fine pressure adjustment and exclude all post-oscillation which usually takes place when a hydraulic or pneumatic drive is used. In addition to a better quality and a greater reliability, the operational costs, associated with manual operations, are reduced, together with the reduction in floor space occupied by the machine resulting from the elimination of hand wheels for operating manually operable spindles. Additional advantage results from using the displacement of an auxiliary side member as a control variable for the adjustment of the rotational speed of the varnishing cylinder, which is necessitated by the Soaking of the cylinder shell or by regrinding.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
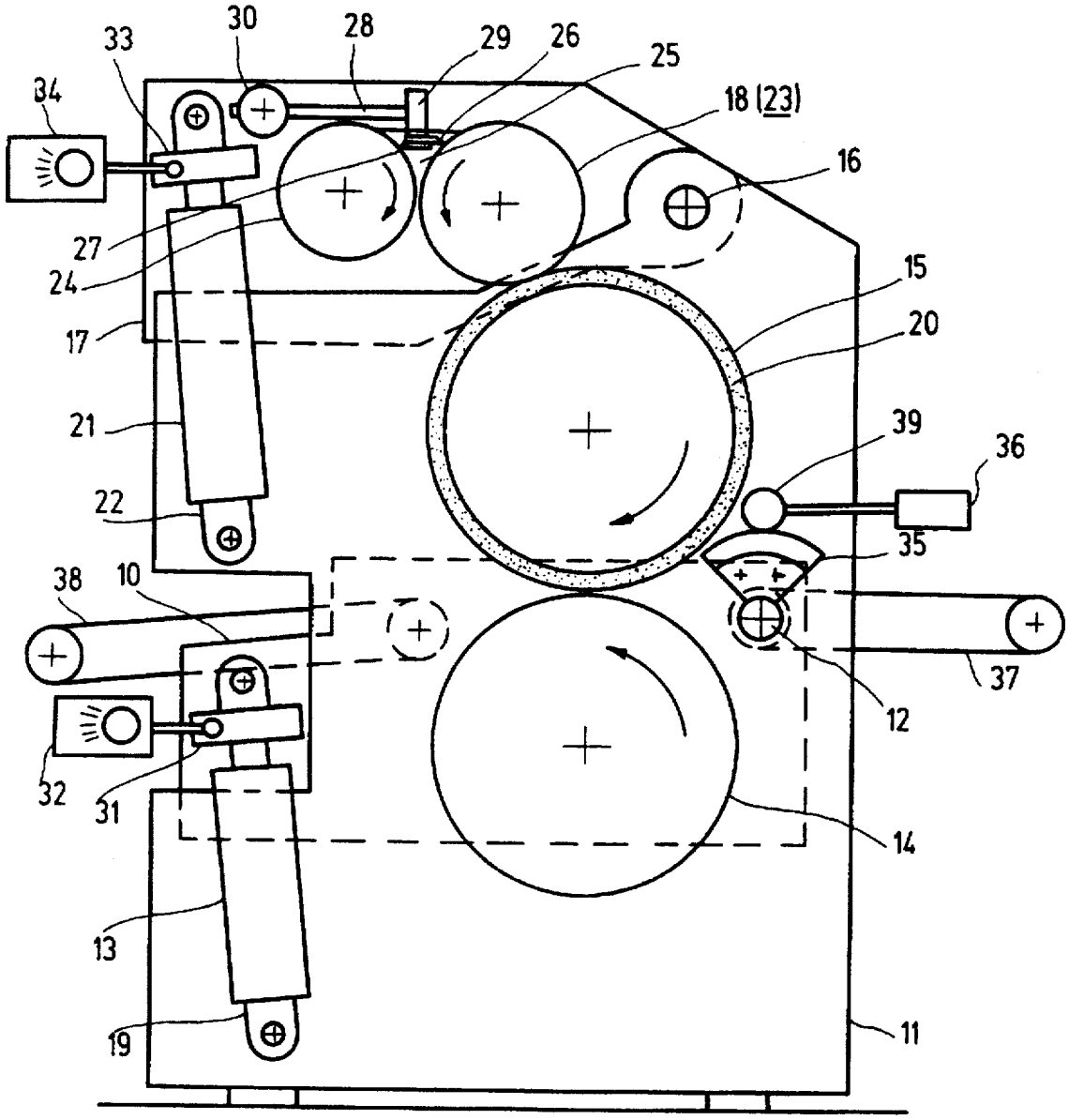
FIG. 1 shows a side view of a varnishing machine according to the present invention having a pivotable pressure cylinder.
Figure 2:
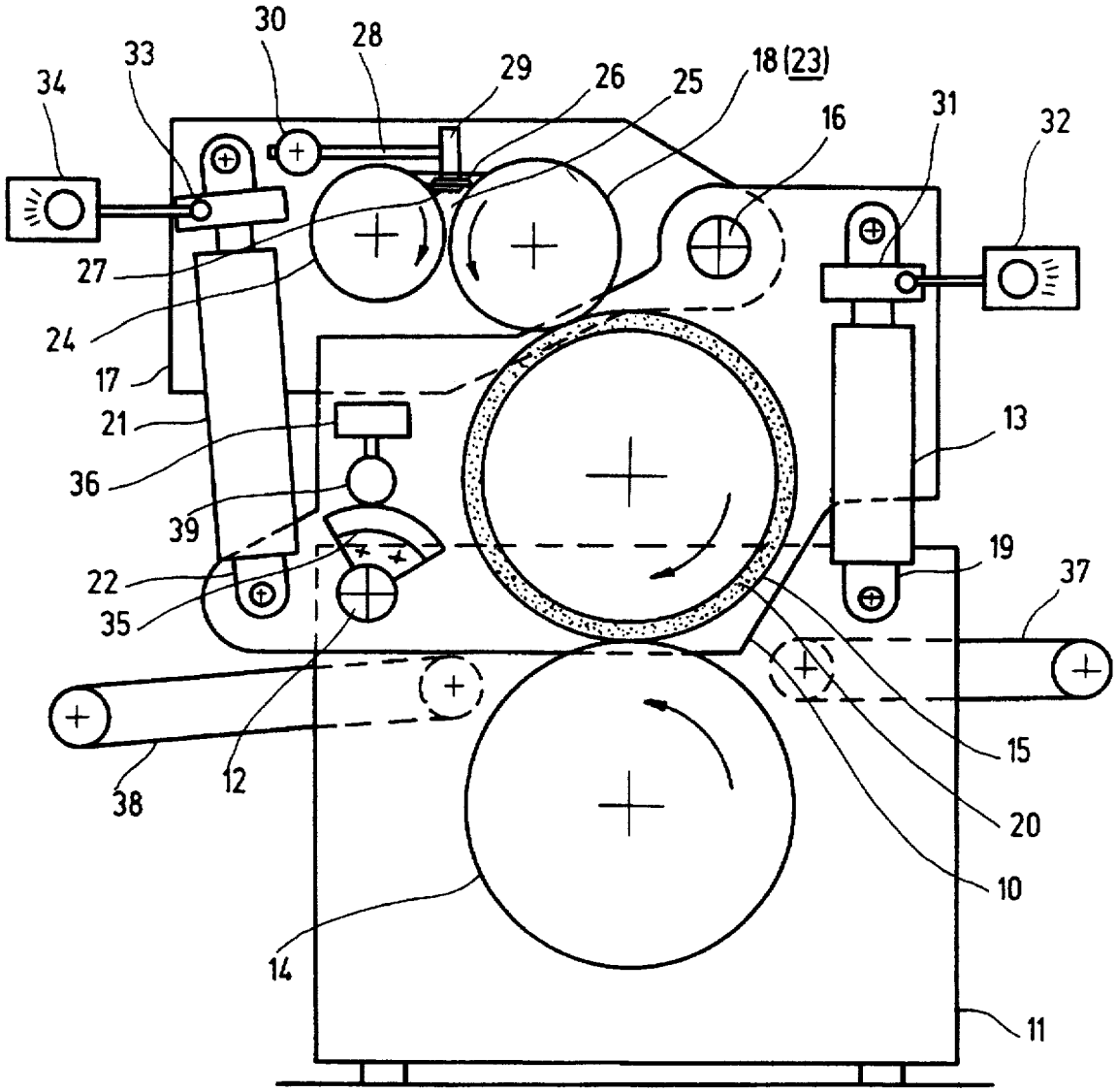
FIG. 2 shows a side view of a varnishing machine according to the present invention.

FIGS. 1 and 2 show two embodiments of a varnishing machine according to the present invention The two embodiments of the inventive varnishing machine distinguish from each other, among others, by the shape of pairs of available auxiliary side members 10 and in the position relative thereto of a pivotal support 12 supported on a machine frame 11. In the inventive varnishing machine, a pressure cylinder 14 or a varnishing cylinder 15, together with its end side support, is arranged between a motor spindle 13, which is supported on the side member 10, and the pivotal support 12. A pivotal support 16 of each of both end side support flanges 17 of a varnish feed roller 18 is arranged either on the stationary machine frame 11 or on the pivotal auxiliary side member 10. The both motor spindles 13 are components of a positioning device 19 for applying pressure between a rubber shell 20 of the varnishing cylinder 15 and the hard pressure cylinder 14, and both motor spindles 21 are components of a positioning device 22 for applying pressure between the varnishing cylinder 15 and the varnish feed roller 18 of the varnish unit 23.

Advantageously, the entire varnish unit 23 is supported on both pivotal support flanges 17 which, in addition, provide for mounting of a device for adjusting pressure applied to the varnishing cylinder 15 of the varnishing machine, and facilitate maintenance of the varnishing machine. A particularly compact and reliable varnish delivery mechanism is obtained by using the .varnish feed roller 18 and a varnishing roller 24 for limiting a varnish basin 25. The varnish feed roller 18 and the varnishing roller 24 preferably rotate in opposite directions in the region of the varnish basin 25 with a step-down speed. A scrapper blade 26 engaging the varnish feed roller 18 and a scrapper blade 27 engaging the varnishing roller 24 are located in the varnish basin 25 one above the other. Both scraper blades 26 and 27 are supported in a common holding device including a support beam 29 having pivot arms 28 for pivoting both scraper blades 26 and 27 upward from the varnish feed roller 18 and the varnishing roller 24 and then back downward. The pivot arms 28 are longitudinally displaceable on a shaft 30 the axis of which extend parallel to the axes of the rollers 18 and 24.

For a more convenient cleaning of the varnishing machine and in order to facilitate maintenance work, both pivotal support flanges 17 and both motor spindles 21, one ends of which are attached to the machine frame 11 or the auxiliary side member 10 and the other ends of which are pivotally attached to the support flange 17, are so mounted that in addition to insuring the application of pressure between the varnishing cylinder 15 and the varnish feed roller 18, they insure access to the varnishing cylinder 15. To this end, the motor spindles have an increased adjusting stroke, the support flanges 17 have an elongated form, and the pivotal supports 16 are spaced from the common contact point of the varnishing cylinder 15 and the varnish feed roller 18 by an increased distance.

The pressure applied to each motor spindle 13 is sensed by a respective pressure sensor 31 and is adjusted to a predetermined constant value by a respective pressure regulator 32 which is connected with the respective sensor 31. Thereby, a completely automatic pressure adjustment between the varnishing cylinder 15 and the pressure cylinder 14 takes place, which also takes into consideration the soaking of the shell 20 of the varnishing cylinder 15 and the regrinding of the varnishing cylinder 15.

The pressure adjustment between the varnishing cylinder 15 and the varnish feed roller 18 is effected in the same manner, with the pressure applied to the motor spindles 21 being sensed by respective pressure sensors 33 and controlled by respective pressure regulators 34, connected with the pressure sensors, 33, to a predetermined constant value.

The angular position of the varnishing cylinder 15, or the pressure cylinder 14, or the varnish feed roller 18 is sensed by a displacement sensor 35 which transmits a position signal to an angular speed controller 36. In the angular speed controller 36, the position signal generated by the sensor 35 is used for controlling the circumferential or angular speed of the varnishing cylinder 15 so that it conforms to that of the pressure cylinder 14. Even at a very large diameter area of the varnishing cylinder, which, apart from swelling of the shell 201, requires often regrinding, the adaptation of the angular speed can be very precise and, at the same time, inexpensive. By adapting the rotational or angular speed of the varnishing cylinder 15, the unused varnish fields of the varnishing cylinder 15 are held stationary on the shell 20 of the varnishing cylinder 15, whereby the bottom sides of the following one another workpieces are kept clean. At that, the belts 38 which are provided, in addition to the inlet belts 37, for removal of the varnished workpieces, are driven synchronously with the rotation of the pressure cylinder 14.

A preferred embodiment of the displacement sensor 35 includes a variable resistance of a potentiometer 39 which rotates in response to the pivotal movement of the auxiliary side member 10. This permits to reduce to a minimum the additional expenditure associated with providing means for controlling the rotational speed of the varnishing cylinder 15. The precision of the adaptation of the rotational speed of the varnishing cylinder 15 is further increased by the fact that the pressure sensor 31, which is associated with the auxiliary side member 10, is connected to the pressure regulator 32 at the middle of the workpiece.

The inlet and outlet belts 37 and 38 are adapted for one-side varnishing of plate-shaped thin metal sheets. However, the varnishing machine can be also used for varnishing of a plate-shaped paper material and cardboard.

Also of importance is a possibility of forming in the varnishing layer areas, which are free of varnish, especially when precise uncovered areas need be provided on foldable blanks of collapsible folding boxes.

Though the present invention was shown and described with reference to the preferred embodiments, various modifications thereof will be apparent to those skilled in the are and, therefore, it is not intended that the invention be limited to the disclosed embodiments or details thereof, and departure can be made therefrom within the spirit and scope of the appended claims.

What is claimed is:

1. A machine for varnishing plate-shaped workpieces, comprising:

a frame;

a varnishing cylinder having a shell formed of an elastic material and two opposite supports;

a pressure cylinder for applying pressure to a workpiece movable between the varnishing and pressure cylinders, the pressure cylinder likewise having two opposite supports;

two auxiliary side members pivotally attached to the frame for supporting the opposite supports of one of the varnishing cylinder and the pressure cylinder;

means for adjusting pressure between the varnishing and pressure cylinder, the pressure adjusting means including two tilting motor spindles for pivoting the two auxiliary side members and having respective one ends thereof attached to the frame and respective another ends thereof attached to the two auxiliary side members, respectively;

pressure sensor means for sensing axial pressure applied by each of the two motor spindles to a respective auxiliary side member, the pressure sensor means comprising two sensors supported on the two motor spindles, respectively;

pressure regulator means connected with the pressure sensor means for controlling the axial pressure and thereby pressure between the varnishing and pressure cylinder to a predetermined constant value;

a displacement sensor for sensing an angular position of one of the two auxiliary side members and supported on a pivotal support of the one of the two auxiliary side members; and control means for compensating changes in rotational speed of the varnishing cylinder caused by one of soaking of the varnishing cylinder shell and regrinding, with a position signal generated by the displacement sensor being used as a control variable, the control means being supported on the frame.

2. A varnishing machine as set forth in claim 1, wherein the displacement sensor comprises a variable resistance of a potentiometer rotatable in accordance with a pivotal movement of a respective auxiliary side member.

3. A varnishing machine as set forth in claim 1, wherein the pressure sensor means comprises two pressure sensors, and the pressure regulator means comprises two pressure regulators each of the two pressure sensors being connected to respective one of two pressure regulators at the middle of the workpiece.

4. A varnishing machine as set forth in claim 1, further comprising a varnishing unit including a varnish feed roller, two support flanges for supporting the varnishing unit, another means for adjusting pressure between the varnishing cylinder and the varnish feed roller, the another pressure adjusting means including two further tilted motor spindles for pivoting the two support flanges, respectively, and having respective one ends thereof attached to one of the frame and an auxiliary side member, and respective another ends thereof attached to respective support flanges, further pressure sensor means for sensing axial pressure applied by the further motor spindles to the respective support flanges, and another pressure regulator means for controlling the axial pressure and thereby pressure between the varnish feed roller and the varnishing cylinder to a predetermined constant value.

5. A varnishing machine as set forth in claim 4, wherein the varnishing unit further includes a varnishing roller which limits, together with varnish feed roller, a varnish basin.

* * * * *